US008806766B1

(12) United States Patent
Lee

(10) Patent No.: US 8,806,766 B1
(45) Date of Patent: Aug. 19, 2014

(54) CIRCLE MARKING DEVICE

(76) Inventor: David M. Lee, Westminster, CA (US)

( * ) Notice: Subject to any disclaimer, the term of this patent is extended or adjusted under 35 U.S.C. 154(b) by 258 days.

(21) Appl. No.: 13/571,081

(22) Filed: Aug. 9, 2012

Related U.S. Application Data

(60) Provisional application No. 61/521,637, filed on Aug. 9, 2011.

(51) Int. Cl.
*B43L 9/02* (2006.01)

(52) U.S. Cl.
USPC ..... 33/27.04; 33/27.02

(58) Field of Classification Search
USPC ..... 33/27.02, 27.03, 27.031, 27.032, 33/27.033, 27.04, 27.05, 27.06, 27.07, 666
See application file for complete search history.

(56) References Cited

U.S. PATENT DOCUMENTS

| | | | | |
|---|---|---|---|---|
| 660,688 | A | 10/1900 | Lipsy | |
| 663,168 | A | 12/1900 | Hembree | |
| 1,201,209 | A | 10/1916 | McMurray | |
| 2,349,670 | A | 5/1944 | Moxey | |
| 3,286,573 | A * | 11/1966 | Esch | 33/27.04 |
| 4,241,506 | A | 12/1980 | LeBlanc et al. | |
| 5,044,245 | A * | 9/1991 | Molleker et al. | 33/27.07 |
| 5,596,809 | A | 1/1997 | Beard | |
| 5,822,871 | A | 10/1998 | Walker | |
| 6,202,530 | B1 * | 3/2001 | Cawley | 33/27.032 |
| 6,907,669 | B1 | 6/2005 | Han et al. | |
| 8,020,305 | B2 * | 9/2011 | Guiney et al. | 33/18.1 |
| 2006/0207114 | A1 | 9/2006 | Stoner | |

* cited by examiner

*Primary Examiner* — Brad Bennett
(74) *Attorney, Agent, or Firm* — QuickPatents; Kevin Prince

(57) ABSTRACT

A tool for applying a circular indicia onto a surface, such as a ceiling, wall or other flat surface, with a marking implement has a base that includes a first side with a center punch projecting away therefrom. At least one marker holder is fixed with a second side of the base and configured to hold the marking implement therein, such that a marking point of the marking implement projects through a marking aperture traversing the base. A handle is selectively removable from the base and is adapted for selective engagement with the center punch to assume a collapsed configuration.

15 Claims, 4 Drawing Sheets

CIRCLE MARKING DEVICE

CROSS-REFERENCE TO RELATED APPLICATIONS

This application claims the benefit of U.S. Provisional Patent Application 61/521,637, filed on Aug. 9, 2011, and incorporated herein by reference.

STATEMENT REGARDING FEDERALLY SPONSORED RESEARCH AND DEVELOPMENT

Not Applicable.

FIELD OF THE INVENTION

This invention relates to tools, and more particularly to a tool for drawing circles on a surface.

DISCUSSION OF RELATED ART

Marking an accurate cutting line on a ceiling, wall or other surface for recessed lighting installation, or the like, is difficult since typically an installer is on a ladder, holding a circular template with one hand, while trying to trace around the template with a marking implement. Not only are such circular templates subject to inadvertent movement, shifting the position of the template away from a desired location, but making such markings with two hands is dangerous when requiring letting go of the ladder.

Therefore, there is a need for a device that allows an installer to draw a circular pattern on a ceiling or other surface at a desired location easily, with one hand. Such a needed device would allow marking of circles of various pre-defined diameters, and would accommodate common contractor marking implements, such as a standard carpenter's pencil. Such a needed invention would be relatively inexpensive to manufacture, and would easily collapse down to a compact, safe collapsed configuration for easy storage and transport. The present invention accomplishes these objectives.

SUMMARY OF THE INVENTION

The present device is a tool for applying a circular indicia onto a surface, such as a ceiling or wall, with a marking implement, such as a standard CP30-type carpenter's pencil. A base has a first side with a center punch projecting away therefrom. At least one marker holder is fixed with a second side of the base and configured to hold the marking implement therein, such that a marking point of the marking implement projects through a marking aperture traversing the base. In one embodiment having multiple marker holders, each marking aperture is a predefined distance from the center punch. Alternately, an elongated marking aperture slidably receives a single adjustable marker holder.

A handle is fixed with the base and projects away therefrom. Preferably the handle is selectively removable from the base and is adapted for selective engagement with the center punch to assume a collapsed configuration, wherein the handle covers a sharp end of the center punch.

In one embodiment the second side of the base includes an attachment groove and the handle includes an attachment member sized similarly to a portion of the marking implement. As such, in a deployed configuration the attachment member may be engaged with the attachment groove to firmly fix the handle with the base, the handle projecting away from the second side of the base. Further, the marking implement may then be fixed within one of the at least one marker holders. Conversely, in the collapsed configuration the handle may be engaged with the center punch on the first side of the base, such as with a friction-fit aperture in the handle, and the marking implement may be fixed with the attachment groove for convenient and compact storage.

In use, with the first side of the base applied to the surface and the center punch traversing at least partially through the surface, and with the marking implement fixed with one of the at least one marker holders, the marking point of the marking implement contacts the surface. The handle may then be rotated such that the marking point applies the circular indicia about the center punch on the surface.

The present invention is a device that allows an installer to draw a circular pattern on a ceiling or wall at a desired location easily, with one hand. The present device allows marking of circles of various pre-defined diameters, and can be fashioned to accommodate a standard carpenter's pencil or other common marking implement. The present invention is relatively inexpensive to manufacture, and easily collapses down to a compact, safe collapsed configuration for easy storage and transport. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figures 1, 2:
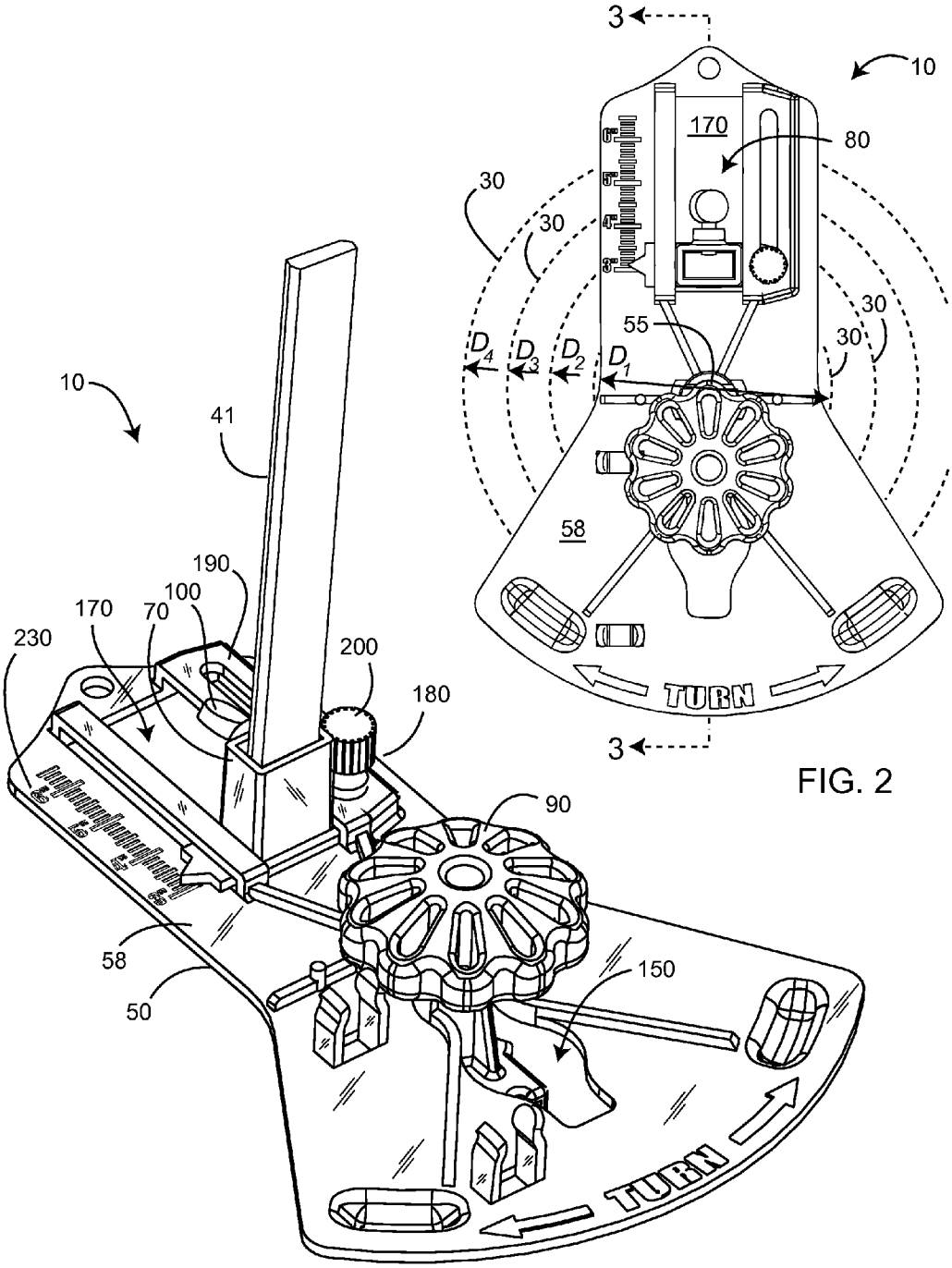
FIG. 1 is a perspective view of the invention, illustrated in deployed configuration.
FIG. 2 is a top plan view thereof.

FIGS. 1-2 illustrate a tool 10 for applying a circular indicia 30 onto a surface 20 with a marking implement 40, such as a standard CP30-type carpenter's pencil 41, ink pen, scribe, or the like.

Figure 5:
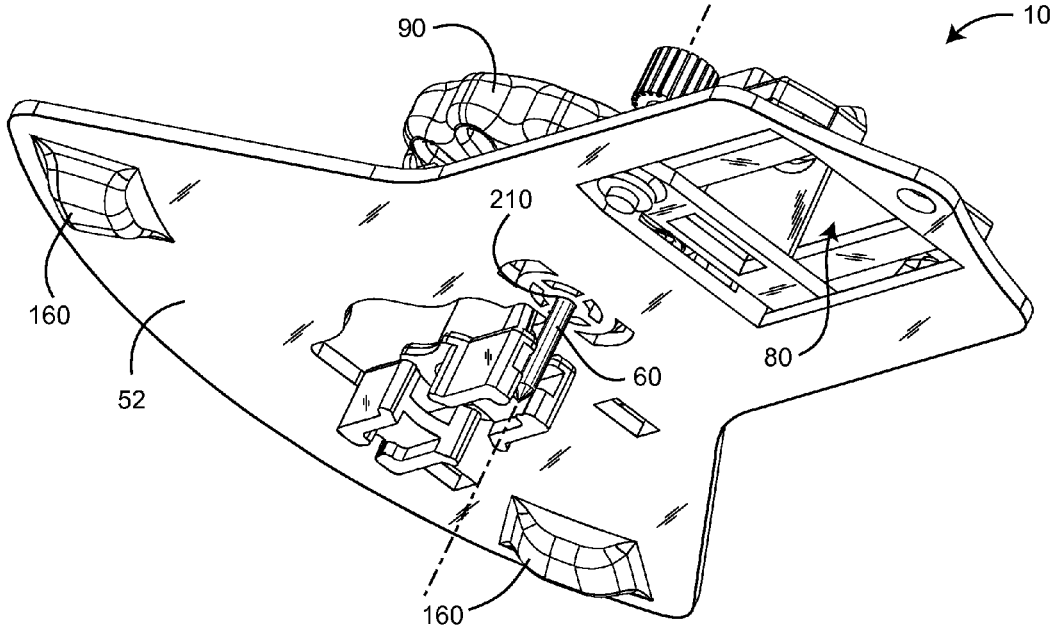
FIG. 5 is a bottom perspective view of FIG. 4.

A base 50 has a first side 52 (FIG. 5) and a second side 58. The first side 52 has a center punch 60 (FIG. 3) projecting away therefrom at a central location 55 thereof and terminating at a sharp end 68. The base 50 may include a nail-capturing aperture 210 (FIG. 3) for example, at the central location 55. Preferably the base 50 further includes an aperture 150 proximate the central location 55 large enough so that a user can see therethrough to where the center punch 60 contacts the surface 20 as the base 50 approaches the surface 20. At least one low-friction pad 160 may be fixed to the first side 52 of the base 50 to facilitate rotation of the base 50 against the surface 20. Alternately such low-friction pads 160 may be protrusions formed in the lower surface 52 of the pad 50, reducing the surface area of the lower surface 52 that contacts the surface 20 when the base 50 is rotated on the surface 20.

Figure 6:
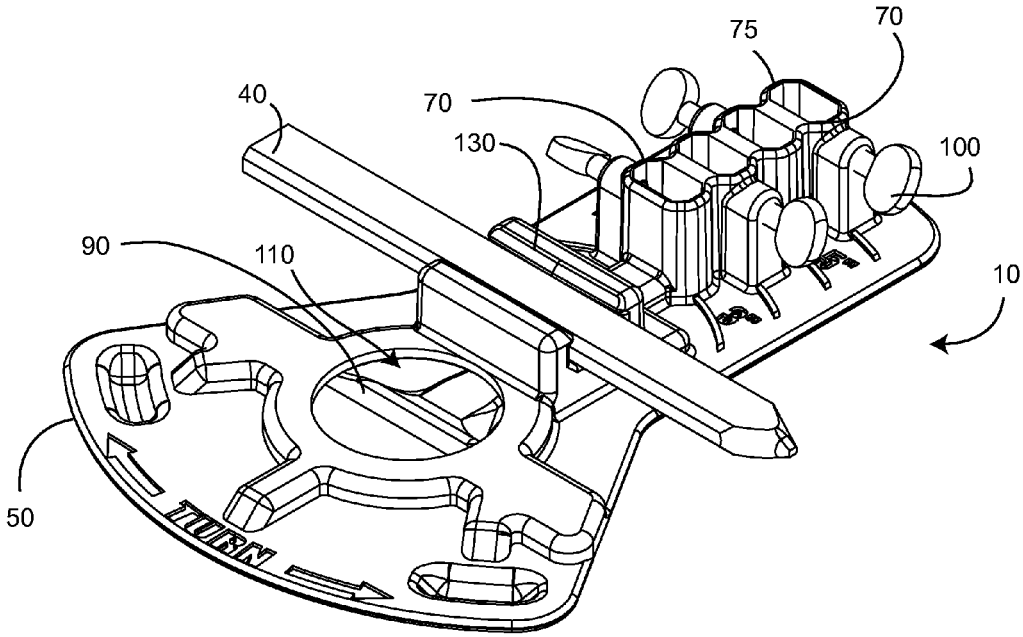
FIG. 6 is a top perspective view of an alternate embodiment of the invention, illustrated in the collapsed configuration.

At least one marker holder 70 is fixed with the second side 58 of the base 50 and configured to hold the marking implement 40 therein, such that a marking point 45 of the marking implement 40 projects through a marking aperture 80 traversing the base 50 from the first side 52 to the second side 58. In one embodiment having a plurality of marker apertures 80 (FIG. 6), each marking aperture is a predefined distance $D_n$ from the center punch 60.

In the preferred mode of the invention (FIGS. 1-5), the tool 10 includes exactly one marker holder 70 and the marking aperture 80 is an elongated aperture 170. The marker holder 70 is slidably captured within the elongated aperture 170 such that the distance between the marking point 45 and the center punch 60 is manually, selectively adjustable. The marker holder 70, in such an embodiment, further includes a position locking mechanism 180 adapted to selectively hold the maker holder 70 fixed at any chosen position within the elongated aperture 170. The locking mechanism may include, for example, an elongated adjustment aperture 190 adjacent and parallel to the elongated marking aperture 170, and a locking screw 200 adapted to manually, selectively apply pressure to the base 50 at the elongated adjustment aperture 190 to hold the marker holder 70 fixed at any chosen position within the elongated aperture 170.

The at least one marker holder 70 preferably includes a mechanical fastener 100 that laterally traverses the marker holder 70 to retain the marking implement 40 within the marker holder 70. In those embodiments having a plurality of marker holders 70, such as four, each mechanical fastener 100 located on alternating sides 75 (FIG. 6) of the marker holders 70 for facilitating the gripping thereof without interference from the mechanical fasteners 100 of adjacent marker holders 70. Each marker holder 70 preferably further includes an indicia 230 indicating the diameter of the circular indicia 30 associated therewith, such as "6 inches" for a marker holder 70 that is three inches from the center punch 60. With four marker holders 70, for example, circles having diameters of three inches, four inches, five inches, and six inches may be represented by marker holders 70 that are 1.5 inches, 2.0 inches, 2.5 inches, and 3.0 inches, respectively, from the center punch 60.

Preferably the base 50 and marker holders 70 are integrally made from a plastic injection molded material, such as ABS, PVC, or the like. In one embodiment, the base 50 is made from a substantially transparent material, such as acrylic or polycarbonate, in which case the aperture 150 may be omitted.

Figure 4:
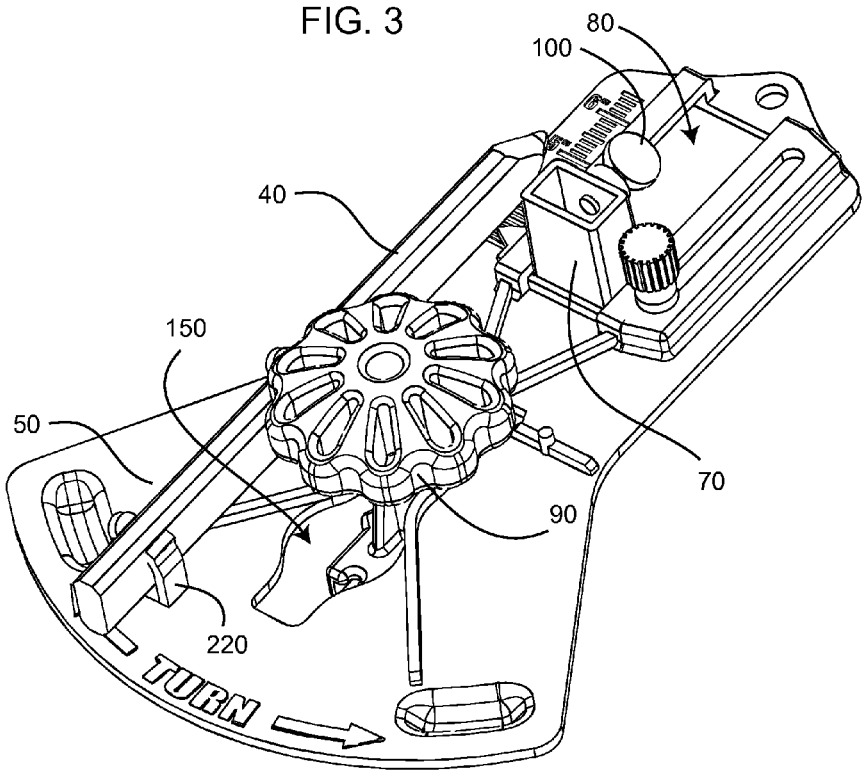
FIG. 4 is a front perspective view of the invention, illustrated in a collapsed configuration.

A handle 90 is fixed with the base 50 proximate the central location 55 and projects away therefrom. In one embodiment the handle 90 is selectively removable from the second side 58 and is adapted for selective engagement with the center punch 60 to assume a collapsed configuration 110 (FIG. 6), wherein the handle 90 is flat against the first side 52 and preferably covers the sharp end 68 of the center punch 60. Alternately, in the collapsed configuration 110 the handle 90 projects through the view aperture 150 to capture the center punch 60 safely therearound (FIG. 5), the handle 90 assuming a low profile for compact storage. In such an embodiment, a pair of holding clips 220 may be fixed with the base 50 to store the marking implement 40 (FIG. 4).

Figure 3:
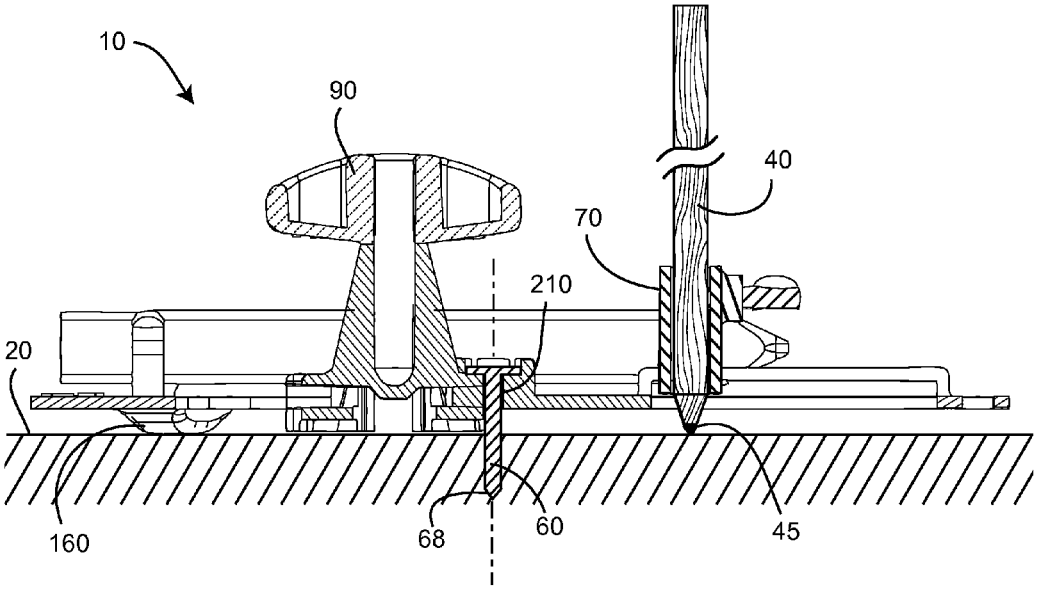
FIG. 3 is a cross-sectional view thereof, taken generally along lines 3-3 of FIG. 2.

Preferably the center punch 60 is sufficiently long, such as one-half inch, so that once punched through the surface 20 the handle 90 may be temporarily released, the center punch 60 having enough surface area contact with the surface 20 to hold the tool 10 to the surface 20 by friction while the user rotates his hand to re-grasp the handle 90. The center punch 60 may be a standard ¾" nail, for example, captured between the handle 90 and the base 50 (FIG. 3).

Figure 7:
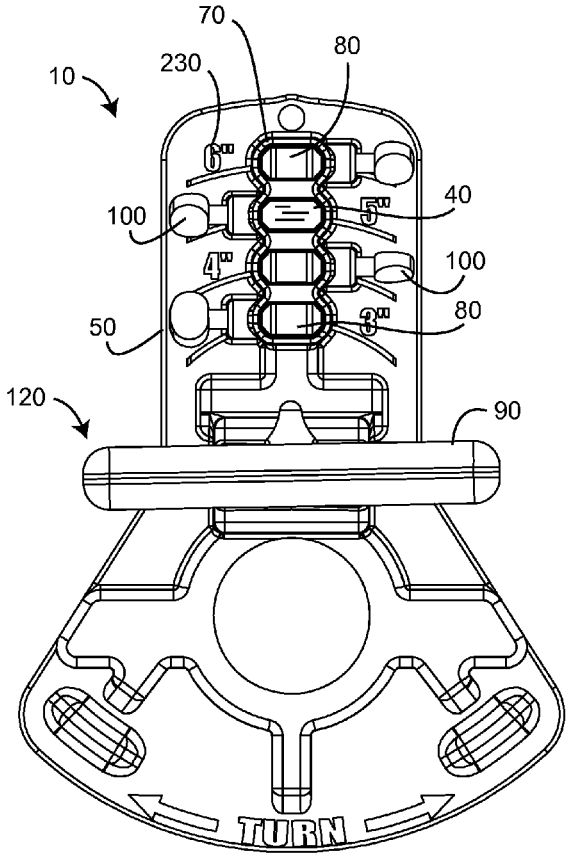
FIG. 7 is a top plan view of FIG. 6, but rather illustrated in the deployed configuration.
Figure 8:
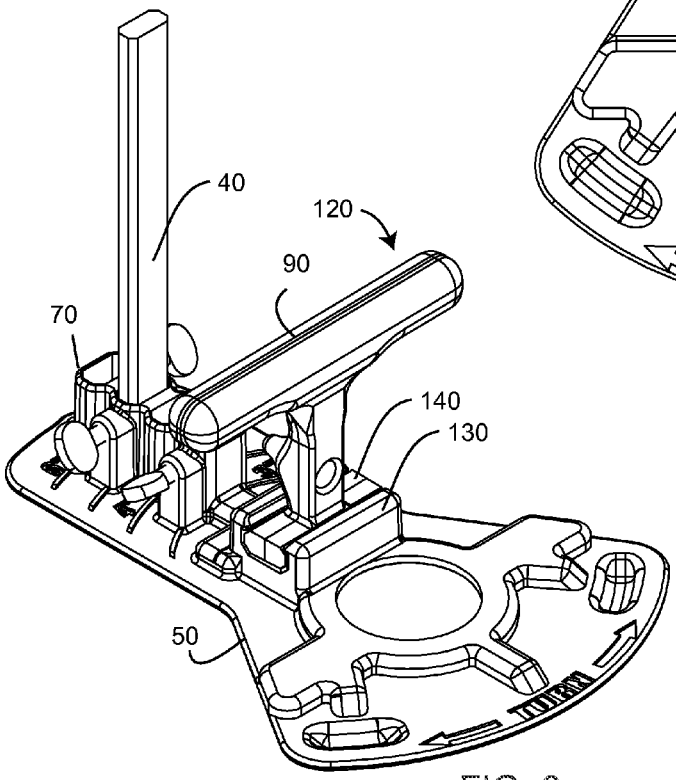
FIG. 8 is a perspective view of FIG. 7.

In one embodiment the second side 58 of the base 50 includes an attachment groove 130 and the handle 90 includes an attachment member 140 sized similarly to a portion 48 of the marking implement 40. As such, in a deployed configuration 120 (FIGS. 7 and 8) the attachment member 140 may be engaged with the attachment groove 130 to firmly fix the handle 90 with the base 50, the handle 90 projecting away from the second side 58 of the base 50. Further, the marking implement 40, such as a standard CP30-type carpenter's pencil, may then be fixed within one of the at least one marker holders 70. Conversely, in the collapsed configuration 110 (FIG. 6) the handle 90 may be engaged with the center punch 60 on the first side 52 of the base 50, such as with a friction-fit aperture 92 in the handle 90, and the marking implement 40 may be fixed with the attachment groove 130 for convenient and compact storage.

In use, with the first side 52 of the base 50 applied to the surface 20 and the center punch 60 traversing at least partially through the surface 20, and with the marking implement 40 fixed with one of the at least one marker holders 70, the marking point 45 of the marking implement 40 contacts the surface 20 at a desired distance from the center punch 60. The handle 90 may then be rotated such that the marking point 45 applies the circular indicia 30 about the center punch 60 on the surface 20.

While a particular form of the invention has been illustrated and described, it will be apparent that various modifications can be made without departing from the spirit and scope of the invention. For example, the shape of the base 50 in the figures is generally Y-shaped, but could be instead shaped as a rectangle, circle, or the suitable shape. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A tool for applying a circular indicia onto a surface with a marking implement having a marking point, comprising:

a base having a first side and a second side, the first side having a center punch projecting away therefrom at a central location thereof;

at least one marker holder fixed with the second side of the base and configured to hold the marking implement therein such that the marking point of the marking implement projects through a marking aperture traversing the base from the first side to the second side; and a handle fixed with the base proximate the central location thereof and projecting away from the second side thereof;

whereby with the first side of the base applied to the surface and the center punch traversing at least partially through the surface, and with the marking implement fixed within one of the at least one marker holders, the marking point of the marking implement contacts the surface, the handle then being rotated such that the marking point applies the circular indicia about the center punch on the surface.

2. The tool of claim 1 wherein each marker holder includes a mechanical fastener that laterally traverses the marker holder to retain the marking implement within the marker holder.

3. The tool of claim 2 wherein the at least one marker holder is a plurality of marker holders, each mechanical fastener located on alternating sides of the marker holders for facilitating the individual gripping thereof.

4. The tool of claim 1 wherein each of the at least one marker holders is adapted to retain a standard CP30-type carpenter's pencil.

5. The tool of claim 1 wherein the handle is selectively removable from the base and is adapted for selective engagement with the center punch to assume a collapsed configuration.

6. The tool of claim 5 wherein the second side of the base includes an attachment groove and wherein the handle includes an attachment member sized similarly to a portion of the marking implement, such that in a deployed configuration the attachment member may be engaged with the attachment groove to firmly fix the handle with the base, the handle projecting away from the base, the marking implement being fixable within one of the at least one marker holders; and alternately such that in the collapsed configuration the handle may be engaged with the center punch on the first side of the base, and the marking implement may be fixed with the attachment groove.

7. The tool of claim 1 wherein the base further includes a viewing aperture proximate the central location sized large enough so that a user can see therethrough to where the center punch contacts the surface as the base approaches the surface.

8. The tool of claim 1 wherein the center punch is at least one-half inch long, such that once punched through the surface the handle may be temporarily released, the center punch holding the tool to the surface by friction.

9. The tool of claim 5 wherein when the handle is in the collapsed configuration, the handle covers a sharp end of the center punch.

10. The tool of claim 1 wherein at least one low-friction pad is formed on the first side of the base.

11. The tool of claim 1 wherein the at least one marker holder is exactly one marker holder, and wherein the marking aperture is an elongated aperture, the marker holder being slidably captured within the elongated aperture such that the distance between the marking point and the center punch is manually, selectively adjustable, the marker holder further including a position locking mechanism adapted to selectively hold the marker holder fixed at any chosen position within the elongated aperture.

12. The tool of claim 11 wherein the position locking mechanism includes an elongated adjustment aperture adjacent and parallel to the elongated marking aperture, and a locking screw adapted to manually, selectively apply pressure to the base at the elongated adjustment aperture to hold the marker holder fixed at any chosen position within the elongated aperture.

13. The tool of claim 1 wherein the center punch is a nail and the base includes a nail-capturing aperture at the central location.

14. The tool of claim 1 wherein the second side of the base includes at least one marking implement holding clip.

15. The tool of claim 11 wherein the second side of the base includes distance indicia adjacent to the elongated aperture, each distance indicia indicating a distance of twice the distance between center punch and the marking point when positioned at the distance indicia.

* * * * *